US010384233B2

(12) United States Patent
Martori

(10) Patent No.: US 10,384,233 B2
(45) Date of Patent: Aug. 20, 2019

(54) ORE SEPARATION WHEEL

(71) Applicant: Joseph J. Martori, Fort Mohave, AZ (US)

(72) Inventor: Joseph J. Martori, Fort Mohave, AZ (US)

( * ) Notice: Subject to any disclaimer, the term of this patent is extended or adjusted under 35 U.S.C. 154(b) by 15 days.

(21) Appl. No.: 15/700,129

(22) Filed: Sep. 10, 2017

(65) Prior Publication Data

US 2018/0071749 A1 Mar. 15, 2018

Related U.S. Application Data

(60) Provisional application No. 62/385,855, filed on Sep. 9, 2016.

(51) Int. Cl.

| | |
|---|---|
| ***B07B 1/08*** | (2006.01) |
| ***B07B 1/46*** | (2006.01) |
| ***B03B 5/74*** | (2006.01) |
| *B03B 5/02* | (2006.01) |

(52) U.S. Cl.

CPC ..... *B07B 1/08* (2013.01); *B03B 5/74* (2013.01); *B07B 1/4654* (2013.01); *B03B 5/02* (2013.01)

(58) Field of Classification Search

CPC ..... B07B 1/08; B07B 1/4654; B03B 5/02; B03B 5/68; B03B 5/74

See application file for complete search history.

(56) References Cited

U.S. PATENT DOCUMENTS

| | | | | | |
|---|---|---|---|---|---|
| 4,406,783 | A | | 9/1983 | Cleland | |
| 4,476,014 | A | * | 10/1984 | Cleland | B03B 5/02 156/160 |
| 4,517,079 | A | | 5/1985 | Cleland | |
| 4,522,711 | A | | 6/1985 | Cleland | |
| 4,561,973 | A | | 12/1985 | Cleland | |
| 5,447,239 | A | | 9/1995 | Tubbs, Jr. | |
| 5,788,293 | A | * | 8/1998 | Krenzler | B03B 5/74 209/434 |
| 5,868,366 | A | * | 2/1999 | Tubbs, Jr. | B03B 5/74 209/434 |
| 5,957,303 | A | * | 9/1999 | Krenzler | B03B 5/02 209/434 |

* cited by examiner

*Primary Examiner* — Joseph C Rodriguez
*Assistant Examiner* — Kalyanavenkateshware Kumar
(74) *Attorney, Agent, or Firm* — Clearstar IP LLC; Michael W. Starkweather

(57) ABSTRACT

Disclosed is a material separation apparatus with a circular ore separation wheel and a number of projected spiral portions, tilted towards a central hole, provided on a concave shaped interior surface. A pair of adjacent projected spiral portions forms less than 90 degree angle to create a negative draft for an upward movement of the heavy materials during rotation of the circular ore separation wheel. The central hole of the circular ore separation wheel is attached with a central hub to rotate the circular ore separation wheel to trap the collected heavy materials in between the adjacent projected spiral portions. The circular ore separation wheel is kept in a tilted position, forming a predetermined tilting angle with the vertical, is rotated at a predetermined speed to help the created negative draft to separate the heavy material(s) from a mixture of heavy and light materials fed into the circular ore separation wheel.

16 Claims, 8 Drawing Sheets

ORE SEPARATION WHEEL

CROSS REFERENCE TO RELATED APPLICATIONS

This application claims the benefit of copending U.S. Provisional Application No. 62/385,855, having the same inventor, Joseph J. Martori, filed on Sep. 9, 2016.

BACKGROUND OF THE INVENTION

Field of the Invention

The present invention relates generally to an apparatus for separating heavy particles (10.0 and heavier specific gravity) of ore and other critical and strategic rare earths and precious metals.

Background of the Invention

In the early eighteenth century period, gold particles are discovered in sand and gravel of stream and riverbeds resulting in the development of different types of apparatus for the separation of gold particles from the sand and gravel. These apparatus employed different separation mechanisms such as using water to wash away the sand, gravel and other particles, retaining only the gold and other heavy metal particles. The above method works on the basis of the difference in specific gravity of gold and other heavy metal particles with sand, gravel and other light dirt particles. The heavy gold and other heavy metal particles having specific gravity of ten and more moves to the bottom of the apparatus during the washing process, which can later be retrieved for further processing. One such apparatus to exploit the difference in specific gravity is provided with a gold pan having a frustum, or truncated conical cylinder, with mildly inclining sides closed on its smaller end by a flat bottom. The method of separation of the heavy gold and other metal particles includes the steps of pouring an amount of raw mineral matter, which contains both light and heavy particles, in the pan and adding appropriate amounts of water. Then the raw mineral matter with the water in the pan is agitated to separate comparatively large pebbles from the finer mineral matter. The agitation action raises large matter above the fine matter. The pan is then moved in a circular motion with the pan sidewall inclined slightly below horizontal to wash away light sand material. With the water moving on the pan sidewall without excess spillage, a swirling action washes the mineral matter with the large and lighter matter being washed off of the pan. In further washing of the matter with gentle agitation, small particles are lifted into the water to create a temporary suspension of the particles with particles of high specific gravity quickly falling back down to the pan sidewall while low specific gravity particles remain in suspension. Thus, particles are separated by specific gravity as particles of low specific gravity are suspended, carried and washed away in water. The process does not achieve a well-defined single separation but a continuum of separation, so it is necessary to repeat the process, progressively separating heavier particles from lighter particles until only the very heaviest, such as gold and other metal particles, remains.

However, even the most skilled gold panner is not successful in recovering all of the gold mixed in the mineral matter using the traditional gold pan. Washing away low specific gravity particles also tends to wash away very small particles of high specific gravity with the sand. To improve the efficiency of the pan, various improvements have been attempted. One such improvement includes employing steps on the pan sidewall that create a pocket to capture the high specific gravity particles falling quickly out of suspension as the suspension flows as a layer over the steps. With the pan sidewall leaning slightly downwardly from horizontal, water progressively falls over succeeding steps and out of the pan carrying low specific gravity particles in suspension with it, as heavier particles fall out of suspension into the corners of the steps. However, all such methods are proved to be unsuccessful and time consuming to recover all or most of the gold and other heavy metal particles from the raw mineral matter.

Another improved apparatus for separating the heavy particles employs a spiral guide wall on the pan sidewall instead of concentric steps. As the pan is rotated instead of moved in a customary circular or orbital motion, small, high specific gravity particles are urged inwardly into the pan center along the guide as low specific gravity particles are washed in suspension from one spiral step to another until they fall out of the pan. However, this method is also proved to be unsuccessful in recovering all or most of the gold and other heavy metal particles from the raw mineral matter.

However, with the introduction of electric motors, the process of separating the gold and other heavy metal particles from the raw mineral matter is performed automatically by rotating the pan having the spiral guide and carrying the mineral matter at a specific angle. The spiral guides traps the gold and other heavy metal particles and guides it through the grooves of the spiral guides to the collecting point. However, many apparatus employing the above said method is not proved to be successful in recovering all or most of the gold and other heavy metal particles from the raw mineral matter. Accordingly, various prior arts have disclosed such related inventions, whereby the provided following patents are herein incorporated by reference for their supportive teachings and enablement criteria for the technology needed to enable one skilled in the art to make and use the subject invention, in which:

U.S. Pat. No. 4,561,973 A titled "Ore concentrator pad assembly" and issued to Cleland Keith discloses a concentrator pad assembly for the concentration of ores. The ore-concentrating apparatus comprises a frame or support, the upper portion of which is pivotable about a horizontal axis in order to adjust the inclination of a drive shaft. Such shaft, when driven by a motor assembly, effects rotation of a fiberglass shell about an axis coincident with that of the shaft, the shell is connected to the shaft by a spider assembly. A hydraulic system effects pivotal movement of shaft and the shell about axis. The motor assembly drives the shaft and shell clockwise and the ore is simultaneously conveyed into the drum by a conveyor. At the same time, lubrication water is sprayed toward the concentrator-pad by spray apparatus. Because of complex gravitational, frictional, and wave actions, the more dense components of the ore are caused to move toward the center of the concentrator-pad assembly and flow outwardly through a central opening for collection by a suitable receiver. However, this apparatus and method of separation is also proved to be unsuccessful in recovering all or most of the gold and other heavy metal particles resulting in the loss of some of the heavy particles with the water.

U.S. Pat. No. 4,522,711 A titled "Ore separator apparatus" and issued to Cleland Keith discloses a rotary bowl for separating particles of ore received in the bowl. The rotary bowl is engaged to a drive rotor. The rotor is made tiltable with the bowl. An idler rotor may be provided to engage the back outer surface, and to cooperate with the drive rotor to provide bowl support. However the tilting and rotating of the bowl still proved to be ineffective in capturing all the gold particles in the grooves.

U.S. Pat. No. 4,406,783 A titled "Apparatus for separating ore" and issued to Cleland Keith discloses an ore separating device of the rotating wheel type, which includes a container, which may be of fiberglass, having a concave portion and an annular flange at its periphery with a pad having ridges on its outer surface complementarily overlying the concave portion and removably secured by fasteners. An annular rim complementarily overlies the peripheral portion of the container and is removably held therein by forwardly inclined vanes, which agitate the ore during rotation of the container. However the curvature, the tilted position and the rotation of the rotating wheel is proved to be ineffective in capturing all the gold particles in the spiraling grooves.

Another prior art U.S. Pat. No. 4,517,079 A titled "Ore separation system" and issued to Cleland Keith discloses an apparatus having a number of ore separating rotary bowls, which are combined in staggered, closely spaced relation to facilitate efficient use and transportation. However the curvature, the tilted position and the rotation of the rotating wheels or the bowls is employs above said steps and addition of multiple bowls is not proved to be effective in capturing all the gold particles in the spiraling grooves.

U.S. Pat. No. 5,447,239 A titled "Gold pan with flukes and stratifiers" and issued to Tubbs, Jr. and George discloses a traditional gold pan with a flat center base with a spiral sidewall guide from a vertical pan rim to the pan base. The spiral sidewall guide incorporates a number of obtuse flukes on the spiral extending into the spiral path to disrupt smooth flow of water and mineral matter. A spiraling guide is also provided on the base leading to a cup at the pan center. On the spiraling base guide is a number of stratifiers extending from the guide base into an outer spiral path. The pan is continuously rotated by an electric motor linked to the back of the by a belt and pulley. However, this apparatus and method of separation is also proved to be unsuccessful in recovering all or most of the gold and other heavy metal particles from the raw mineral matter. (Not for commercial mining production)

In all the above prior arts, especially the patents, U.S. Pat. Nos. 4,522,711 4,406,783 A, 4,561,973 A, discloses a concave shaped bowl or wheel design, but the concave wheel does not have a negative draft riffle to trap and enable the upward movement and separation of the heavy particles. The above patents disclose squared riffles (90 deg. from base) relying on the tilt of the apparatus to capture the heavy materials. With no negative draft, the water knocks off the concentrates instead of transporting to the center drop through of the wheel, especially on flat backs. In some of the prior arts, the concentrating wheel can be tilted to hold the heavy materials only for a split second until the water flushes the heavy material out of the riffle, as there is no negative draft to hold the material in to collect and move up the concentrating wheel.

Despite the various teachings of the incorporated references provided above, none of the art taken singly or in combination provides an effective apparatus and a method for effective or optimal separation of the gold and other heavy particles from a mixture of light and heavy particles. Hence, there is a need for an improved apparatus that would be capable of separating the heavy particles and effectively guiding the heavy particles through spiraling grooves to a collection point. Moreover the needed apparatus would have a number of teeth uniquely shaped so that they form a negative draft. Up to this time, there has not been a single apparatus offering teeth with negative draft for the effective separation of the heavy particles including gold from the mixture of light and heavy particles.

SUMMARY

In view of the foregoing disadvantages inherent in the known types of apparatus like in the prior art, the present invention provides an improved material separation apparatus for effectively separating one or more heavy materials from a mixture of heavy and light materials. As such, the general purpose of the present invention, which will be described subsequently in greater detail, is to provide a new and improved apparatus with all the advantages of the prior art and none of the disadvantages According to an exemplary embodiment, the present invention provides a material separation apparatus for separating one or more heavy materials and other critical and strategic rare earths and precious metals from a mixture of heavy and light materials. The present material separation apparatus includes a circular ore separation wheel having an exterior surface, a concave shaped interior surface, and a central hole. The circular ore separation wheel is tilted slightly away from a vertical direction and rotatably supported on a supporting means. The circular ore separation wheel includes a number of projected spiral portions provided on the concave shaped interior surface. The projected spiral portions are in a spiral shape, which start from the central hole and radially and spirally extends out to a periphery of the circular ore separation wheel. Each of the projected spiral portions protrudes out from the concave shaped interior surface and tilts towards the central hole of the circular ore separation wheel. This enables the present material separation apparatus to create a negative draft for the upward movement of the heavy materials from the mixture of heavy and light materials towards the central hole during the rotation of the circular ore separation wheel. The projected spiral portions on the concave shaped interior surface are closely arranged to have a saw-tooth cross-section with a number of teeth. The adjacent teeth in the saw-tooth cross-section of the projected spiral portions or the adjacent projected spiral portions tilted towards the central hole make an angle less than 90 degrees with each other. The angle between the adjacent projected spiral portions, depending on a number of factors including the diameter of the circular ore separation wheel, a tilting angle of the circular ore separation wheel with the vertical, radius of curvature of the concave shaped interior surface etc. The present material separation apparatus further includes a circumferential wall having an inner surface and an outer surface. A bottom edge of the circumferential wall is attached to the periphery of the circular ore separation wheel. The circumferential wall attaches to the periphery of the circular ore separation wheel at almost 90 degrees. A number of triangular projecting strips, each having a predetermined height, angularly extend from the bottom edge to a top edge of the circumferential wall and projects out from the inner surface of the circumferential wall. A circular lip portion is attached to the top edge of the circumferential wall to guide the ore off of the separation wheel, for disposal. The central hole of the circular ore separation wheel is attached with a central hub to rotate the circular ore separation wheel and to receive the collected heavy materials in between adjacent projected spiral portions on the circular ore separation wheel. The circular ore separation wheel kept in a tilted position, forming a predetermined tilting angle with the vertical, is rotated at a predetermined speed in conjunction with a predetermined water flow for using the negative draft to trap, and carry upwards towards the center and separate the heavy material(s) from the mixture of other materials fed into the circular ore separation wheel, and transfer the collected heavy material(s) through the central hole.

A method of extracting the heavy materials from the mixture of heavy and light materials includes the steps of rotatably placing the assembled material separation apparatus on a supporting structure making a predetermined tilting angle with the vertical. The tilting angle of the circular ore separation wheel is determined based on a number of factors including, but not limited to, the diameter and the radius of curvature of the circular ore separation wheel, the negative draft angle or the angle between the adjacent projected spiral portions on the concave shaped interior surface of the circular ore separation wheel, etc. Once the material separation apparatus is set up and operational, the mixture of light and heavy materials is continuously deposited into a pocket (about 90°+/−10° pocket were the flange meets the concave) section of the material separation apparatus. The mixture of light and heavy materials deposited near the periphery of the circular ore separation wheel, within the pocket section formed by the triangular projecting strips attached to the inner surface of the circumferential wall, is immediately separated to capture the heavy materials within the pocket section. The light dirt materials are allowed to pass over the triangular projecting strips to the circular lip portion for disposal. The heavy materials and the remaining light materials retained in the pocket section are moved upwards and separated, by using a negative draft, through the riffle pattern or through the valleys of the projected spiral portions, during the rotation of the present material separation apparatus. During the gradual upward movement from the periphery towards the central hole of the circular ore separation wheel, the heavy materials get trapped in the valleys formed between the adjacent projected spiral portions. The negative draft angle or the angle less than 90° made by adjacent teeth or the adjacent projected spiral portions enables the entrapment and the upwards movement of the heavy materials having specific gravity of 10 and more during the rotation of the tilted circular ore separation wheel. The heavy materials, after passing through the projected spiral portions, are collected from the central hole for further processing.

Accordingly, it is a primary feature of the present invention to provide a material separation apparatus capable of separating heavy materials such as gold with specific gravity of at least 10 and other valuable or strategic heavy metals and minerals with specific gravities of 10 or more.

Another feature of the present invention to provide a material separation apparatus having a circular ore separation wheel with a number of triangular projected spiral portions making a negative draft angle with the curvature of the circular ore separation wheel.

Another feature of the present invention to provide a material separation apparatus with a number of triangular projected spiral portions making a negative draft angle less than 90 degrees between each other for trapping the heavy materials.

Yet another feature of the present invention to provide a material separation apparatus in a variety of dimensions with different negative draft angles within 10-89 degrees for creating a negative draft to trap the heavy materials.

Yet another feature of the present invention to provide a material separation apparatus having a number of triangular projected spiral portions with varying heights and widths on the same riffle run from a periphery to the center of the circular ore separation wheel.

Another feature of the present invention to provide a material separation apparatus having a pocket section formed by an inner surface of a circumferential wall and a triangular projecting strip with enough depth to hold the heavy materials and dispose the light materials immediately after the deposition of the mixture of light and heavy materials.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

To further clarify various aspects of some example embodiments of the present invention, a more particular description of the invention will be rendered by reference to specific embodiments thereof that are illustrated in the appended drawing. It is appreciated that the drawing depicts only illustrated embodiments of the invention and are therefore not to be considered limiting of its scope. The invention will be described and explained with additional specificity and detail through the use of the accompanying drawing(s) in which.

DETAILED DESCRIPTION OF THE INVENTION

Figure 1:
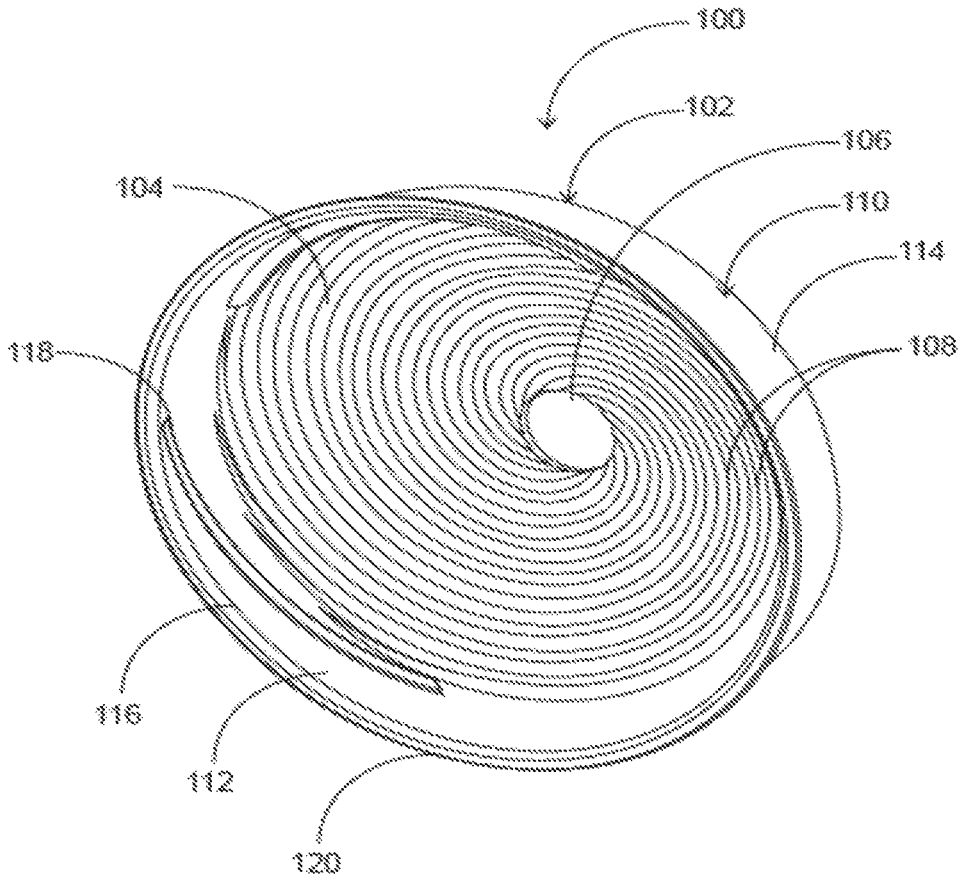
FIG. 1 illustrates a perspective view of the present material separation apparatus for separating one or more heavy materials from a mixture of heavy and light materials, according to a preferred embodiment of the present invention.

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. Any figures and accompanied descriptions provided in the background art provided above are to also be considered in the understanding of the present invention and potential operation thereof. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent to one skilled in the art from the following detailed description of the invention when considered in conjunction with the drawings and the other incorporated by reference art provided.

This section summarizes some aspects of the present disclosure and briefly introduces some preferred embodiments. Simplifications or omissions in this section as well as in the abstract or the title of this description may be made to avoid obscuring the purpose of this section, the abstract and the title. Such simplifications or omissions are not intended to limit the scope of the present disclosure nor imply any limitations.

The present invention relates to a material separation apparatus for separating one or more heavy materials or critical and strategic rare earths and precious metals from a mixture of heavy and light materials, according to one or more embodiment of the present invention. The present material separation apparatus incorporates a bowl shaped structure for depositing the mixture of light and heavy materials. The bowl shaped structure is supported on the supporting means and is tilted, making an acute angle with a vertical direction, and coupled to a dynamic rotating means for rotating the apparatus at a desired speed. The present material separation apparatus includes an inward curved or concave shaped interior surface having a number of projections of radially expanding spiral rings surrounding a central opening or hole on the bowl shaped structure. These projections spiraling inward curved or concave shaped interior surface is closely arranged and provided with a certain angle, making less than 90 degrees with the curvature of the concave shaped interior surface. The projections (Riffles, teeth, valley) spiraling on the concave shaped interior surface are all tilted towards the center of the material separation apparatus and makes a negative draft angle that is less than 90 degrees from a base support layer. This negative draft angle creates a negative draft to enable gradual movement of the heavy particles, such as, but not limited to gold and other strategic and valuable metals, minerals and rare-earths particle having a specific gravity of 10 and more, from a periphery of the bowl shaped structure of the material separation apparatus towards the central opening, trapping the heavy particles in the valleys formed by the negative draft riffle shaped projections on the concave shaped interior surface, during the rotation of the material separation apparatus. The tilting angle of the bowl shaped structure or the material separation apparatus, diameter and curvature of the bowl shaped structure, the angle of the flange, tilting angle of the riffles (teeth and valley sections) on the concave shaped interior surface, and the negative draft angle between adjacent projections are all interdepended for effective collection of the heavy materials and the disposal of the light materials from the deposited mixture of heavy and light materials.

FIG. 1 illustrates a perspective view of the present material separation apparatus 100 for separating one or more heavy materials from a mixture of heavy and light materials, according to a preferred embodiment of the present invention. The present material separation apparatus 100 includes a circular ore separation wheel 102 having an exterior surface, a special shaped concave interior surface according to the size of the apparatus 104, and a central hole 106. The circular ore separation wheel 102 is tilted slightly from a vertical direction and rotatably supported on a supporting means (not shown), positioning the central hole 106 further away from the periphery of the circular ore separation wheel 102. The circular ore separation wheel 102 includes a number of projected spiral portions 108 provided on the concave shaped interior surface 104. The projected spiral portions 108 are in a spiral shape, which start from the outer edge of the apparatus spiraling towards the central hole 106 and radially and spirally extend out to a periphery 142 of the circular ore separation wheel 102. Each of the projected spiral portions 108 protrudes out from the concave shaped interior surface 104 and tilts towards the central hole 106 of the circular ore separation wheel 102. This enables the upward movement of the heavy materials from the mixture of heavy and light materials towards the central hole 106 during the rotation of the circular ore separation wheel 102. The projected spiral portions 108 on the concave shaped interior surface 104 are closely arranged to have a saw-tooth cross-section with a number of teeth. The adjacent teeth in the saw-tooth cross-section of the projected spiral portions 108 or the adjacent projected spiral portions 108 tilted towards the central hole 106 make a negative draft angle 144 (FIGS. 2C and D) less than 90 degrees with each other. In a certain embodiment of the present invention, the negative draft angle 144 between the adjacent projected spiral portions 108, tilted towards the central hole 106, ranges between 10 degrees to 89 degrees, depending on a number of factors including, but not limited to, the diameter of the circular ore separation wheel 102, a tilting angle of the circular ore separation wheel 102 with the vertical etc.

The present material separation apparatus 100 further includes a circumferential wall 110 that has a degree of angle having an inner surface 112, an outer surface 114, a top edge and a bottom edge. The bottom edge of the circumferential wall 110 is attached to the periphery 142 of the circular ore separation wheel 102. The angle at which the circumferential wall 110 attaches to the periphery 142 of the circular ore separation wheel 102 depends on a number of factors including, but not limited to, the diameter of the circular ore separation wheel 102, the tilting angle of the circular ore separation wheel 102, speed of rotation of the circular ore separation wheel 102, specific gravity of the heavy material to be collected etc. A number of triangular projecting strips 118 are attached to the inner surface 112 of the circumferential wall 110. The triangular projecting strips 118, each having a predetermined height, extend from the bottom edge to the top edge of the circumferential wall 110 and projects out from the inner surface 112 of the circumferential wall 110. Each of the triangular projecting strips 118 are angularly attached to the inner surface 112 of the circumferential wall 110, extending from its bottom edge, which is proximate to the periphery 142 of the circular ore separation wheel 102, to the top edge of the circumferential wall 110. The present material separation apparatus 100 further includes a circular lip portion 120 attached to the top edge of the circumferential wall 110. In some instances, the circular lip portion 120 continuously extends outwards from the top edge of the circumferential wall 110. In some instances, the circular lip portion 120 forms an obtuse angle or an almost right angle with the outer surface 114 of the circumferential wall 110 to guide the light materials, separated from the mixture of light and heavy materials fed to the circular ore separation wheel 102, for disposal. The central hole 106 of the circular ore separation wheel 102 is further attached with a central hub 116 to receive the collected heavy materials in between adjacent projected spiral portions 108 on the circular ore separation wheel 102. In some instances, the outer surface 114 of the circumferential wall 110 attached to the periphery 142 of the circular ore separation wheel 102 is attached with a wear plate (not shown) for rotating the circular ore separation wheel 102 in a tilted position, forming a predetermined tilting angle with the vertical, at a predetermined speed for separating the heavy material(s) from the mixture of heavy and light materials fed into the circular ore separation wheel 102.

Figure 2A:
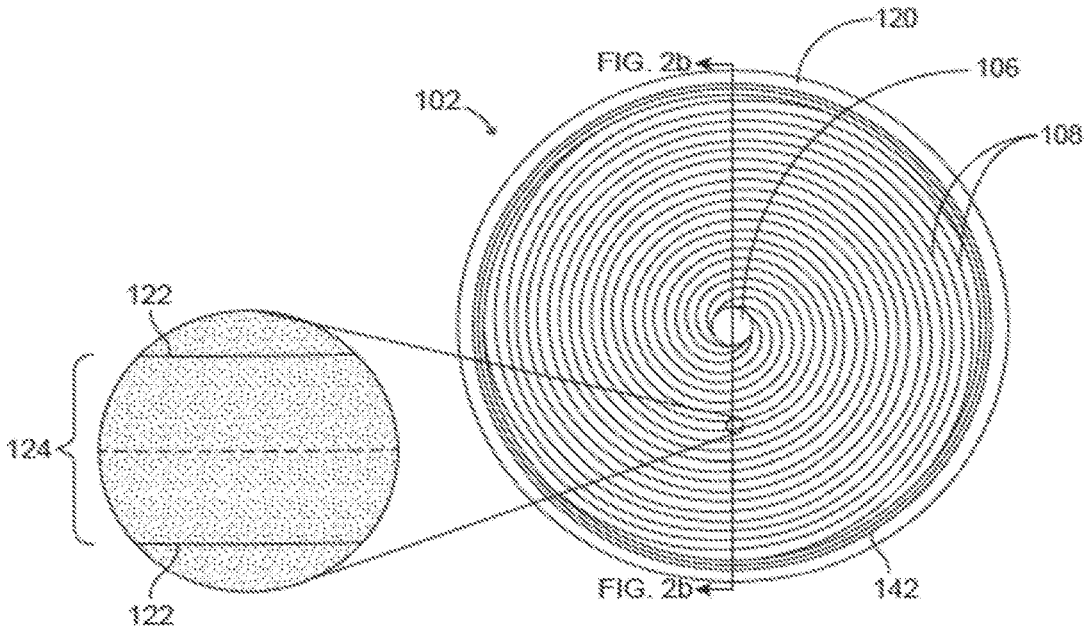
FIG. 2*a* is a front view of the circular ore separation wheel of the present material separation apparatus capable of separating one or more heavy materials from the mixture of heavy and light materials, according to a preferred embodiment of the present invention.

Structure and functions of each part of the present material separation apparatus 100 is discussed below using figures FIG. 2*a* to FIG. 4*b*, according to one or more embodiment of the present invention. FIG. 2*a* is a front view of the circular ore separation wheel 102 of the present material separation apparatus 100 capable of separating one or more heavy materials from the mixture of heavy and light materials, according to a preferred embodiment of the present invention. The present circular ore separation wheel 102 is provided with a unique bowl shaped specific ratius design with the concave shaped interior surface 104 attached with the number projected spiral portions 108, projecting inwards from the concave shaped interior surface 104, each making a certain acute angle 146 with curvature of the circular ore separation wheel 102 and a blank angle 144. In an embodiment of the present invention, the circular ore separation wheel 102 may be made from advanced three dimensional, 3D, printing technology using a single type of or a combination of materials such as polymer material, and the support base may be selected from fiberglass and/or rigid fiberglass reinforced plastic and/or a rigid fiber reinforced plastic material. In some embodiments, the projected spiral portions 102,110,120 and the circular ore separation wheel 102 may be made from the same material and formed using 3D printing techniques. In some other embodiment, the projected spiral portions 108 on the concave shaped interior surface 104 of the circular ore separation wheel 102 may be made from high performance hybrid elastomeric polymer alloy and/or a high performance thermoplastic polyurethane using 3D printing techniques.

In some embodiment, the circular ore separation wheel 102 with the projected spiral portions 108 on its concave shaped interior surface 104 may be made from a single block of fiber-reinforced material. In some other embodiments, the circular ore separation wheel 102 having the concave shaped interior surface 104 and curved exterior surface is supported using an additional rigid structure, potentially made from a rigid material such as, fiberglass and or fiberglass reinforced plastic material. In an other embodiment, the concave shaped interior surface 104 and the exterior surface of the circular ore separation wheel 102 is carved at a certain angle, which depends on a number of predetermined factors including, the total diameter of the circular ore separation wheel 102, the negative draft angle 144 between adjacent projected spiral portions 108 (riffles) on the concave shaped interior surface 104 of the circular ore separation wheel 102, the tilting angle of the circular ore separation wheel 102 with the vertical circumferential wall etc. In some instances, the circular ore separation wheel 102 is used for the commercial mining separation of heavy materials including gold and other strategic/critical heavy valuable metals, minerals and rare-earths with a specific gravity of 10.0 and higher from dirt. The circular ore separation wheel 102 can be made with any predetermined diameter, such as, but not limited to, 18-inch, 2-foot, 3-foot, 4-foot, 5-foot, 6-foot, 7-foot, 8-foot, 9-foot, 10-foot, 11-foot and 12-foot.

Figure 2B:
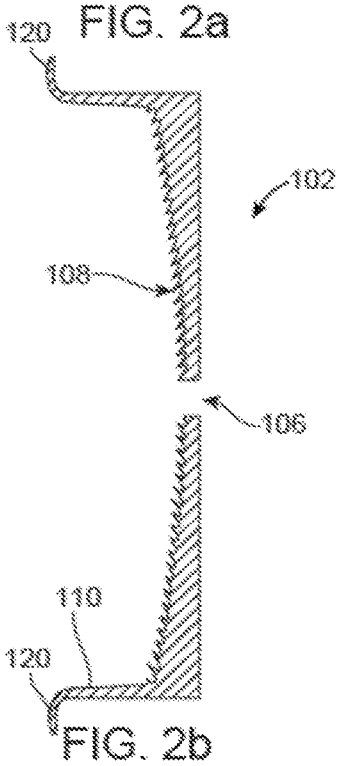
FIG. 2*b* is a sectional side view of a certain small size material separation apparatus capable of separating one or more heavy materials from the mixture materials, according to a preferred embodiment of the present invention.

FIG. 2*b* is a sectional side view of one embodiment of the present material separation apparatus 100 (also referred to as a pad, or ore separation pad) capable of separating one or more heavy materials from the mixture of heavy and light materials, according to a preferred embodiment of the present invention. The sectional side view of the present material separation apparatus 100 shows the circular ore separation wheel 102, the projected spiral portions 108 on the concave shaped interior surface 104 of the circular ore separation wheel 102, the circumferential wall 110 having the triangular projecting strips 118 attached to the periphery 142 of the circular ore separation wheel 102 and the circular lip portion 120 attached to the top edge of the circumferential wall 110. The projected spiral portions 108, which is shown as the saw-tooth cross-section with the plurality of teeth 108, on the concave shaped interior surface 104 forms a riffle shape and includes a number of ridges 122 and valleys 124, as shown in the cross-section of the circular ore separation wheel 102. In a preferred embodiment, each of the projected spiral portions 108 on the concave shaped interior surface 104 of the circular ore separation wheel 102 is tilted at a certain acute angle 146 and 144 towards the central hole 106 of the circular ore separation wheel 102 to enable movement of the light and heavy particles from the periphery 142 of the circular ore separation wheel 102 to the central hole 106, i.e. during the rotation of the circular ore separation wheel 102, which is tilted at a certain angle with the vertical, the heavy particles from the periphery 142 of the circular ore separation wheel 102 gradually moves to the central hole 106, by getting entrapped and passing through the valleys 124, and the light materials passes over the ridges 122 of the riffle shaped projected spiral portions 108 for separate collection and disposal.

Figure 2C:
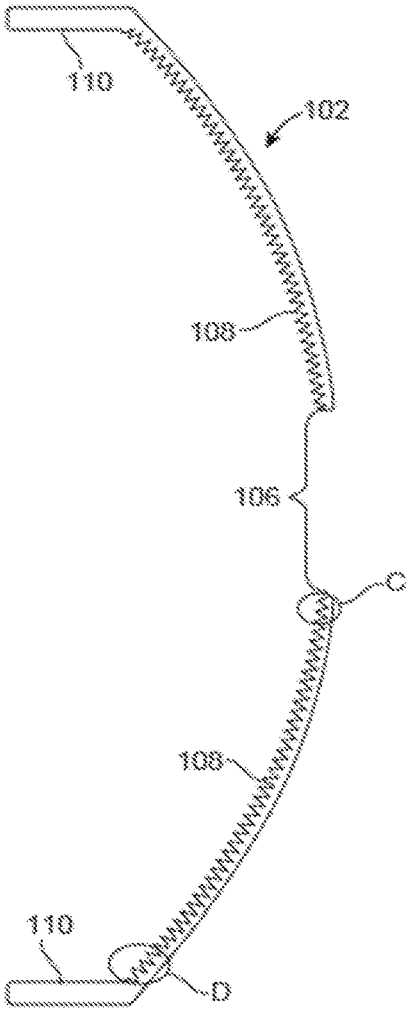
FIG. 2*c* shows an enlarged cross sectional view of the circular ore separation wheel showing the saw-tooth shaped projected spiral portions on the concave shaped interior surface, near the central hole, of the circular ore separation wheel, according to an embodiment of the present invention.
Figure 2C:
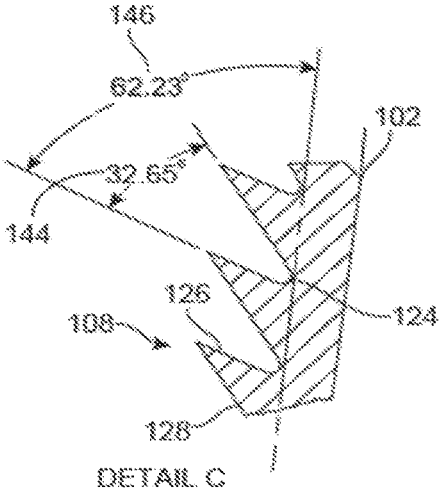

FIG. 2*c* shows an enlarged cross sectional view of the circular ore separation wheel 102 showing the saw-tooth shaped projected spiral portions 108 on the concave shaped interior surface 104, near the central hole 106, of the circular ore separation wheel 102, according to an embodiment of the present invention. The saw-tooth shaped projected spiral portions 108 includes the ridges 122 (also referred to as teeth), which are top ends of the projected spiral portions 108 (also referred to as teeth) and the valleys 124, which forms a shallow space between the adjacent projected spiral portions 108 on the concave shaped interior surface 104 of the circular ore separation wheel 102. Each of the saw-tooth shaped projected spiral portions 108 includes a capture edge 126 to capture the heavy materials and a progression edge 128 to enable movement of the heavy materials gradually through the valleys 124 to the central hole 106. In one embodiment of the present invention, the negative draft angle 146 is less than 90 deg. from the horizontal plane supplied by the base section of the wheel 102. Further, the valleys 124 connecting between the adjacent ridges, i.e. the point of contact of the riffle capture edge 126 and the riffle progression edge 128, is provided with a radius of curvature selected based on the negative draft angle 144 between the riffle capture edge 126 and the riffle progression edge 128. In one or more embodiments of the present invention, the angle 144 between the riffle capture edge 126 and the riffle progression edge 128 connects the adjacent ridges 122. Further, one or more embodiment of the present invention provides the projected spiral portions 108 having the negative draft angle(s) 144 and varying heights and widths from the periphery 142 to the central hole 106 of the circular ore separation wheel 102. In a preferred embodiment, the height of the ridges 122 of the projected spiral portions tilted towards the central hole 106 gradually decreases from the periphery 142 to the central hole 106 of the circular ore separation wheel 102. The height and width of the projected spiral portions 108 provided on the concave shaped interior surface 104 of the circular ore separation wheel 102 is largest at the periphery 142 and decreases gradually towards the central hole 106 of the circular ore separation wheel 102.

Figure 2D:
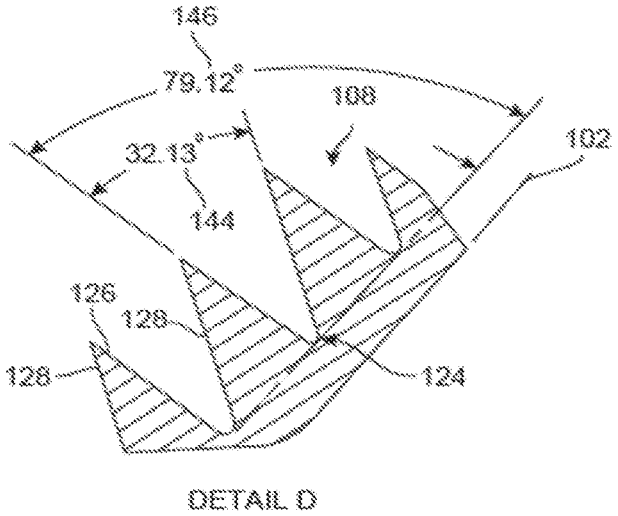
FIG. 2*d* shows an enlarged cross sectional view of the circular ore separation wheel showing the saw-tooth shaped projected spiral portions with curved valleys on the concave shaped interior surface, near the periphery of the circular ore separation wheel, according to an embodiment of the present invention.

FIG. 2*d* shows an enlarged cross sectional view of the circular ore separation wheel 102 showing the saw-tooth shaped projected spiral portions 108 (teeth) with curved valleys 124 on the concave shaped interior surface 104, near the periphery 142 of the circular ore separation wheel 102, according to an embodiment of the present invention. The angle 146 between the saw-tooth shaped projected spiral portions 108 and the circular ore separation wheel 102, also known as the tilt or the tilting angle or major angle made by the projected spiral portions 108 with the circular ore separation wheel 102 is less than 90 degrees. In certain embodiment, the major angle 146 between the teeth of the saw-tooth shaped projected spiral portions 108 and the circular ore separation wheel 102 can be varied in a range of about 89.9 to 20 degree, or 80 to 45 degree, or 75 to 50 degree, or 70 to 60 degree, etc., all within the 90 degree value and remain within the scope of the present invention. This design of the saw-tooth shaped projected spiral portions 108 and the circular ore separation wheel 102 may be achieved using specialized 3D printing techniques. This design also helps to achieve one or more negative draft angle(s) 146. The negative draft angle 146 creates a negative draft during the rotation of the circular ore separation wheel 102, which is tilted at a certain angle from the vertical, to gradually move the heavy materials upwards from the periphery 142 to the central hole 106 of the circular ore separation wheel 102. The negative draft thus created enables the heavy materials, having a specific gravity of 10.0 or higher, to be trapped in the valleys 124 of the projected spiral portions 108, gradually moving through it with the rotation, before finally extracting through the central hole 106 of the circular ore separation wheel 102.

According to one or more embodiment of the present invention, the negative draft angle 144 between the teeth of the saw-tooth shaped projected spiral portions 108 is not possible using expensive conventional manufacturing and is achieved using the 3D printing method. The negative draft angle 146 is kept below 90 degrees to effectively capture and hold the heavy material with specific gravity 10.0 or more during the rotation of the circular ore separation wheel 102 and to transport it all the way to the central hole 106 of the circular ore separation wheel 102. The negative draft angle 146 works in conjunction with the radius of curvature of the concave shaped interior surface of the circular ore separation wheel 102, the angle 146 between the teeth of the saw-tooth shaped projected spiral portions 108 and the circular ore separation wheel 102 and the tilting angle of the circular ore separation wheel 102 to effectively capture and transport the heavy material with specific gravity 10.0 or more, all the way to the central hole 106 of the circular ore separation wheel 102.

In another embodiment, the radius of curvature of the concave shaped interior surface of the circular ore separation wheel 102 work in conjunction with height of the circumferential wall 110 and the angle 146 of the saw-tooth shaped projected spiral portions 108 to create a negative draft transportation system for the heavy material.

FIG. 2*c* and FIG. 2*d* shows negative draft angles 146 and the angles made by the projected spiral portions 108 near the periphery 142 and the central hole 106, respectively. From the figures, it is clear that the height, size and width of the projected spiral portions 108 varies from the periphery 142 to the central hole 106 of the circular ore separation wheel 102. As the height, size and width of the projected spiral portions 108 varies from the periphery 142 to the central hole 106, the negative draft angle 144 between the adjacent teeth or the angle between the riffle capture edge 126 and the riffle progression edge 128 connecting the adjacent ridges 122 varies. However, the variations in the negative draft angle 144 lies within the 90-degree limit, as shown in figures, where the negative draft angle 144 varies from 32.13 degrees to 32.65 degrees near the central hole 106 of the circular ore separation wheel 102 and the angle 146 made by the projected spiral portions 108 with the curvature of the concave shaped interior surface 104 of the circular ore separation wheel 102 varies from 79.12 degrees to 62.23 degrees, which lies within the 90 degree limit.

Figure 3:
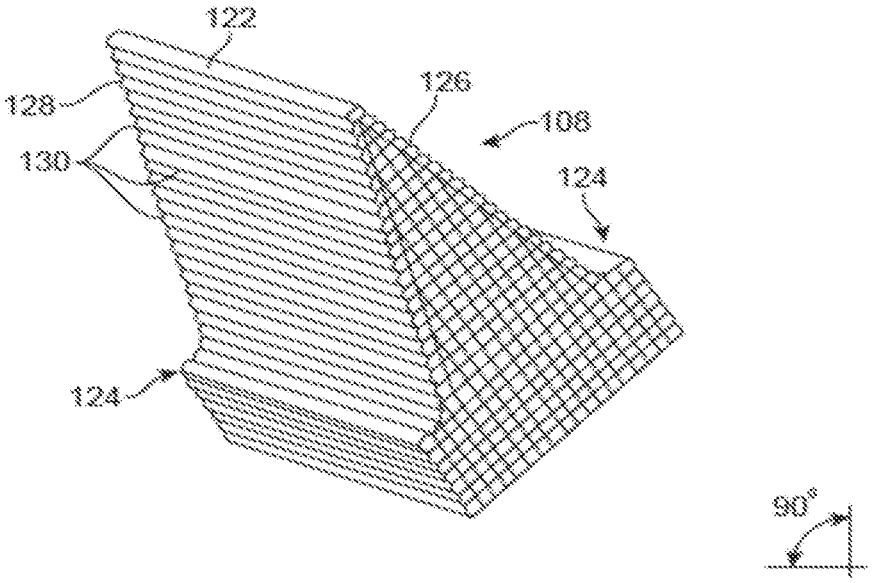
FIG. 3 shows an enlarged cross sectional view of a single tooth of the projected spiral portion on the concave shaped interior surface, according to an embodiment of the present invention.

FIG. 3 shows an enlarged cross sectional view of a single teeth 108 of the projected spiral portion 108 on the concave shaped interior surface 104, according to an embodiment of the present invention. A number of microgrooves or adjacent micro lines 130 forming a riffle are provided on the surface of each of the teeth or the projected spiral portions 108. These microgrooves or adjacent micro lines 130 on the surface of each of the teeth 108 or the projected spiral portions 108 enables or assists in the movement of the materials over the projected spiral portions 108 during rotation of the circular ore separation wheel 102. These patterns formed by the microgrooves or adjacent micro lines 130 on the surface of the projected spiral portions 108 is believed to create a molecular layer of air and/or a wetting agent such as APSA-80 and water, sprayed into the circular ore separation wheel 102, during rotation of the circular ore separation wheel 102 to assist the gradual movement and separation of the materials from the periphery 142, over the ridges 122 of the projected spiral portions 108, towards the central hole 106 of the circular ore separation wheel 102.

Figure 4A:
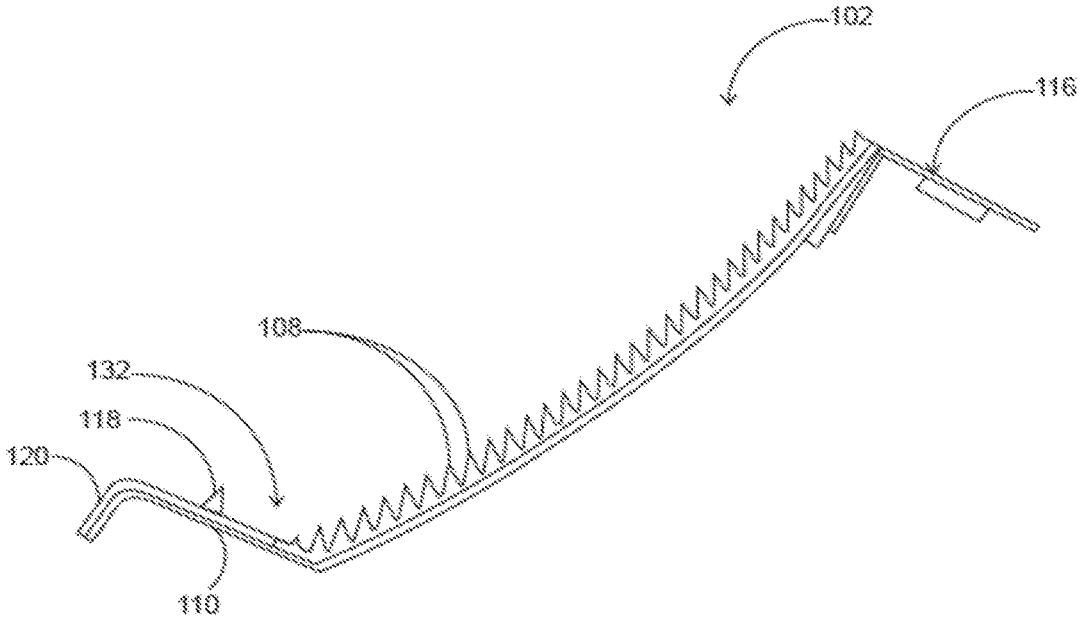
FIG. 4*a* shows a sectional side view of a lower half of the present material separation apparatus, according to an embodiment of the present invention.
Figure 4B:
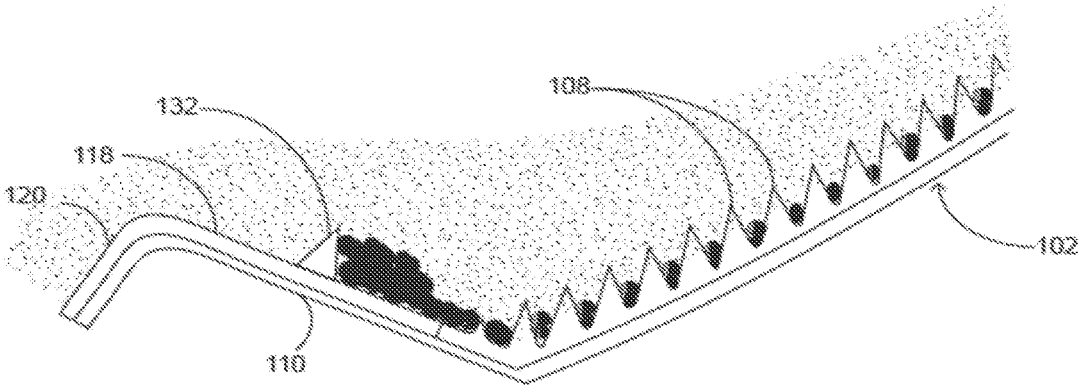
FIG. 4*b* shows a pocket section formed by the inner surface of the circumferential wall attached to the periphery of the circular ore separation wheel, according to an embodiment of the present invention.

Referring now to FIG. 4*a*, which shows a sectional side view of a lower half of the present material separation apparatus 100, according to an embodiment of the present invention. The lower half and upper half are the same and comprise the present material separation apparatus 100, and further shows the circular ore separation wheel 102 attached with the projected spiral portions 108 or teeth, the circumferential wall 110 attached with the circular lip portion 120, which acts as a wear plate, and the triangular projecting strips 118 on the inner surface 112 of the circumferential wall 110, according to an embodiment of the present invention. The inner surface 112 of the circumferential wall 110 attached to the periphery 142 of the circular ore separation wheel 102 forms a pocket section 132, as shown in an exploded view in FIG. 4*b*, to immediately collect the materials deposited into the circular ore separation wheel 102. The depth of the pocket section 132 the predetermined size of the apparatus, the angle between the circumferential wall 110 (90+/−10 deg.) and the curvature of the circular ore separation wheel 102 all act together to aid in the separation process. The depth of the pocket section 132 also includes triangular projecting strips 118 attached to the inner surface 112 of the circumferential wall 110 are designed to further assist the separation of the materials from the mixture deposited into the circular ore separation wheel 102. When the circular ore separation wheel 102 rotates, the heavy materials captured in the pocket section 132 moves upwards from the periphery 142, and gets trapped in the valleys 124 formed between adjacent projected spiral portions 108. These heavy materials with specific gravity of 10 and more are gradually guided through the valleys 124 formed between adjacent projected spiral portions 108 towards the central hole 106.

Figure 5:
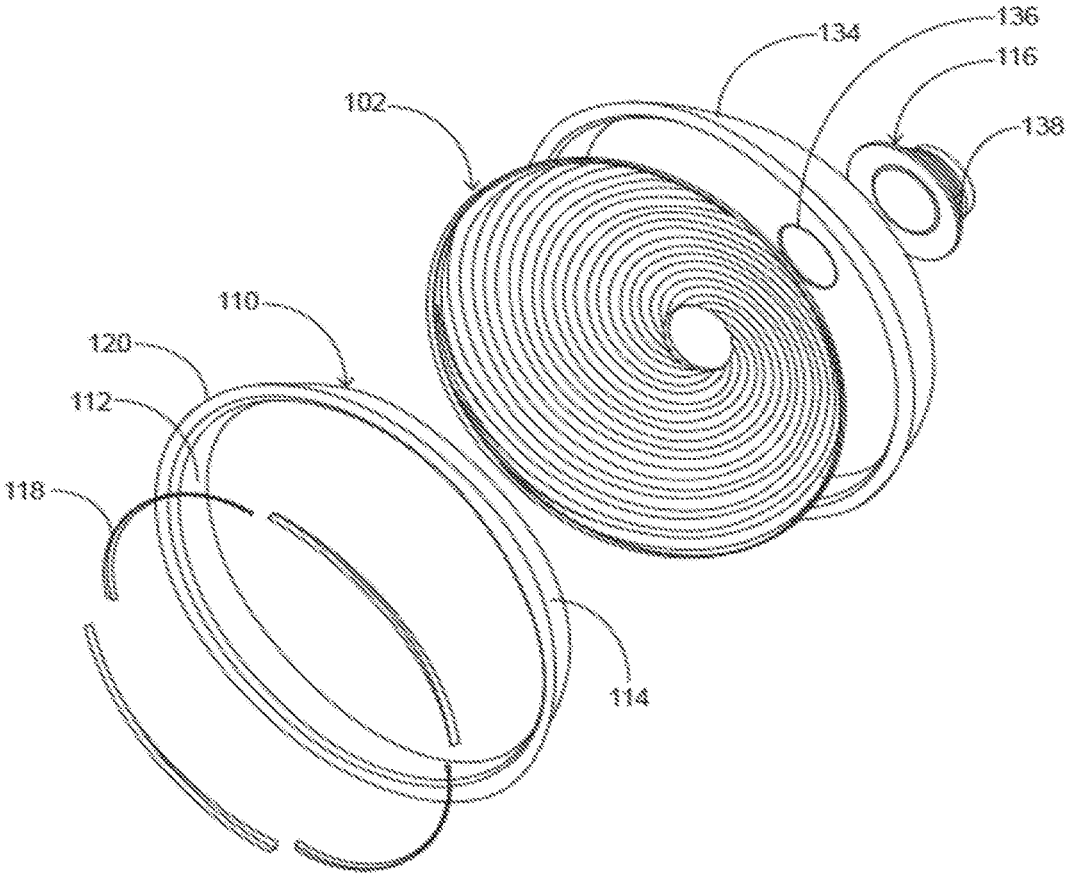
FIG. 5 is an exploded view of the present material separation apparatus capable of separating one or more heavy materials from the mixture of heavy and light materials, according to a preferred embodiment of the present invention.

FIG. 5 is an exploded view of the present material separation apparatus 100 capable of separating one or more heavy materials from the mixture of heavy and light materials, according to a preferred embodiment of the present invention. The circular ore separation wheel 102 with the concave shaped interior surface 104 is supported using a rigid fiberglass reinforced plastic structure 134, which provides both structural rigidity and prevents deformations of the circular ore separation wheel 102 during the deposition of the mixture of heavy and light materials into the concave shaped interior surface 104 and rotation of the circular ore separation wheel 102. The rigid fiberglass reinforced plastic structure 134 also includes a centrally placed hole 136 to align with the central hole 106 provided on the circular ore separation wheel 102. The central hub 116 includes a passageway for passing the heavy materials separated from the mixture of heavy and light materials and the light materials washed away by the natural wetting agent such as water. The central hub 116 further includes a gear 138, which enables the rotation of the circular ore separation wheel 102, rotatably tilted at a particular angle, at a preset speed. The mixture of heavy and light materials are deposited near the periphery 136 of the rotating circular ore separation wheel 102 and the triangular projecting strips 118 attached to the inner surface 112 of the circumferential wall 110. The triangular projecting strips 118 attached to the inner surface 112 of the circumferential wall 110 angularly extends from the bottom edge to the top edge of the circumferential wall 110. The circumferential wall 110 attached to the periphery 142 of the circular ore separation wheel 102 makes an angle between 2 degrees to 10 degrees to a vertical direction and creates the pocket section 132 with the attached triangular projecting strips 118 to immediately capture the heavy materials within the curved pocket section 132 formed by the triangular projecting strips 118 on the inner surface 112 of the circumferential wall 110. The angle made by the circumferential wall 110 with the vertical direction, depends on a number of factors including the diameter of the circular ore separation wheel 102, tilting angle of the circular ore separation wheel 102, etc. The rotating circular ore separation wheel 102 disposes the dirt containing the light materials accumulated in the curved pocket section 132, by passing it over the triangular projecting strips 118 and the circular lip portion 120. The heavy materials collected in the pocket section 132 is retained there for a specific period, depending the speed of rotation and the tilting angle of the circular ore separation wheel 102, and the negative draft angle between adjacent teeth 108 of the saw-tooth shaped projected spiral portions 108. The wear plate is attached to the outer surface 114 of the circumferential wall 110 by attaching through welding or bolting and enables the circular ore separation wheel 102 to be kept at a tilted portion making a predetermined tilting angle with the vertical and rotated at a predetermined speed for optimal separation of the heavy materials.

According to an embodiment of the present invention, the mixture of light and heavy materials is deposited into the pocket section 132 during the rotation of the circular ore separation wheel 102. In a preferred embodiment, the width and angle of the circumferential wall 110 with the vertical direction, the depth of the pocket section 132, the tilting angle of the circular ore separation wheel 102 and the height of the triangular projecting strips 118 influences the effective in the capture of the heavy materials, with specific gravity of 10 and more, from the deposited light and heavy materials. For example, a 3-foot circular ore separation wheel 102 is provided with a 6-inch width circumferential wall 110 and a height of the triangular projecting strips 118 of three quarters of one inch, a 5-foot circular ore separation wheel 102 is provided with a 9-inch width circumferential wall 110 a height of the triangular projecting strips 118 of of one inch and an 8-foot circular ore separation wheel 102 is provided with a 12-inch width circumferential wall 110 and a a height of the triangular projecting strips 118 of one and a half inches. The width of the circumferential wall 110 is primarily determined based on the diameter of the circular ore separation wheel 102. The depth of the pocket section 132 is an important factor in effective capture of the heavy materials and quick, but not to quick deposition of the light materials from the deposited light and heavy materials all before the heavy material starts the climb to the center. An optimal depth of the pocket section 132 is identified based on the width and angle of the circumferential wall 110 with the vertical direction, the tilting angle of the circular ore separation wheel 102 and the height of the triangular projecting strips 118. For example, for an 18-inch diameter circular ore separation wheel 102, a 3-inch+/−10% depth for the pocket section 132 is provided. Similarly, for a 2 feet circular ore separation wheel 102, a 4.25-inch+/−10% depth for the pocket section 132 is provided. For a 3-feet circular ore separation wheel 102, a 6-inch+/−10% depth for the pocket section 132 is provided and for the 5 feet circular ore separation wheel 102, a 9-inch+/−10% depth for the pocket section 132 is provided. For an 8 foot circular ore separation wheel 102, a 12-inch+/−10% depth for the pocket section 132 is provided for the effective and immediate capture of the heavy materials, with specific gravity of 10 and more, from the deposited light and heavy materials. This configuration of the diameter of the circular ore separation wheel 102 and the depth for the pocket section 132 is also beneficial for the instant disposal of the light materials and dirt, over the triangular projecting strips 118 and the circular lip portion 120, according to one or more embodiment of the present invention. The suitable selection of the depth for the pocket section 132 and the height of the triangular projecting strips 118 prevents clogging or deposition of the light materials and dirt within the pocket section 132 for an extended period of time.

The number of triangular projecting strips 118 attached to the inner surface 112 of the circumferential wall 110 and the attaching angles are appropriately selected based on the width of the circumferential wall 110, diameter of the circular ore separation wheel 102, etc. For example, an 18-inch circular ore separation wheel 102 is provided with three triangular projecting strips 118, a 2-foot circular ore separation wheel 102 is provided with up to four triangular projecting strips 118, a 3-foot, 4-foot, and 5-foot circular ore separation wheels 102 are provided with four triangular projecting strips 118 and a 8, 9, 10, 11, and 12 foot circular ore separation wheels 102 may be provided with up to six triangular projecting strips 118. The height, number and the angle of attachment of the triangular projecting strips 118 attached to the inner surface 112 of the circumferential wall 110 depends on many factors, including the depth of the pocket section 132, height and angle of the projected spiral portions 108 and the diameter and the curvature of the circular ore separation wheel 102, for temporarily keeping the heavy materials for a short period of time such as for less than 3-5 seconds.

Further, the circular lip portion 120 attached to the top edge of the circumferential wall 110 forms almost right angles with the outer surface 114 of the circumferential wall 110 for effective disposal of the light materials and dirt present in the deposited light and heavy materials. In some embodiments, the circular lip portion 120 continuously extends out from the top edge of the circumferential wall 110 and prevents the migration of the light materials and dirt back to the outside back surface of the wheel 102. The width of the circular lip portion 120 can be varied depending on the diameter of the circular ore separation wheel 102, such as, for a 3-foot circular ore separation wheel 102 a two-inch circular lip portion 120 is provided. Similarly for a 5-foot circular ore separation wheel 102 a three-inch circular lip portion 120 and for an 8-foot circular ore separation wheel 102 a four-inch circular lip portion 120 is provided etc.

Figure 6:
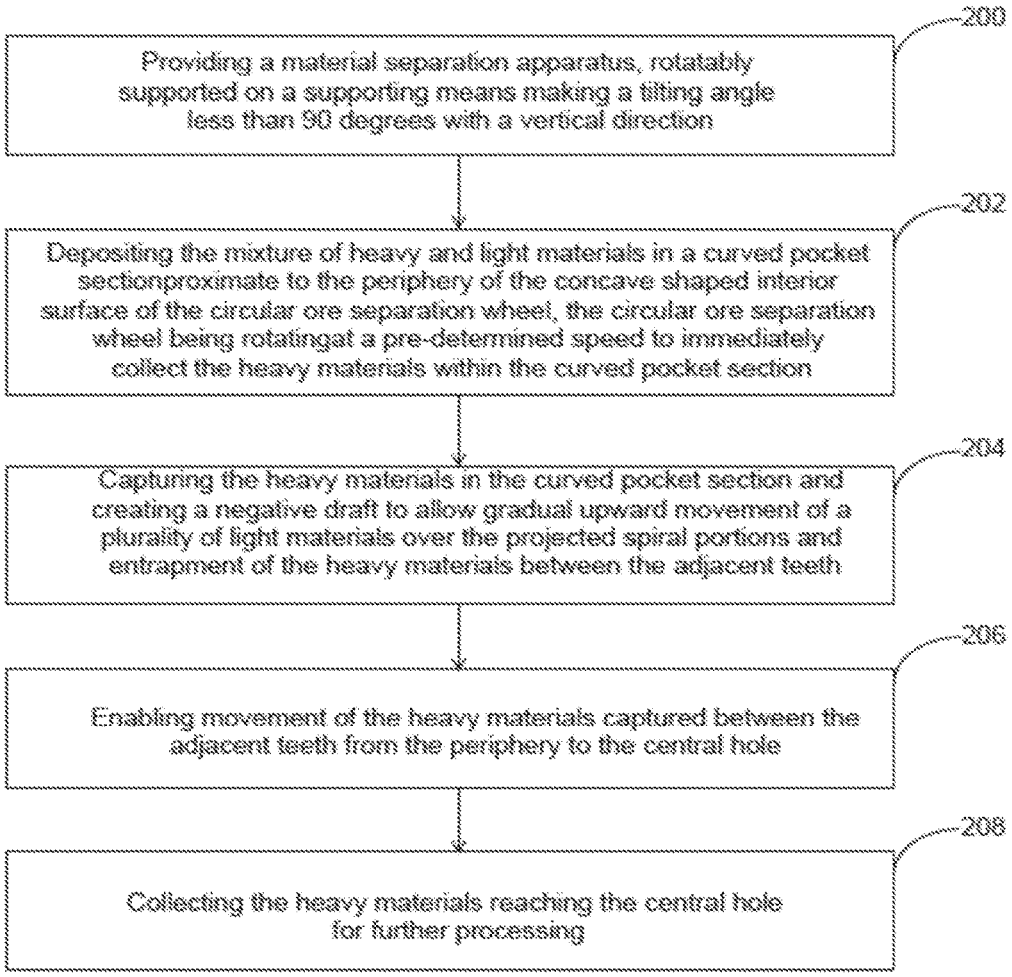
FIG. 6 is a flowchart showing a number of steps for separating one or more heavy materials from the mixture of heavy and light materials of utilizing the present material separation apparatus, according to a preferred embodiment of the present invention.

FIG. 6 is a flowchart showing a number of steps for separating one or more heavy materials from the mixture of heavy and light materials of utilizing the present material separation apparatus 100, according to a preferred embodiment of the present invention. The method of extracting the heavy materials from the mixture of heavy and light materials starts with the tilted placement of the assembled material separation apparatus 100 on a supporting structure, as shown in block 200. The tilting angle of the circular ore separation wheel 102 is determined based on a number of factors including, but not limited to, the diameter and the radius of curvature of the circular ore separation wheel 102, the negative draft angle or the angle between the adjacent teeth of the saw-tooth shaped projected spiral portions 108 on the concave shaped interior surface 104 of the circular ore separation wheel 102, etc. Further, the gear 138 associated with the central hub 116 is connected to a rotating means such as a motor to rotate the material separation apparatus 100 at a desired speed. The material separation apparatus 100 is tilted, using the supporting means making a tilting angle less than 90 degrees with the vertical. Once the material separation apparatus 100 is set up and operational, the mixture of light and heavy materials is continuously deposited into the concave shaped interior surface 104 of the rotating circular ore separation wheel 102, as in block 202. The mixture of light and heavy materials is deposited near the periphery 142 of the circular ore separation wheel 102 immediately reaches the pocket section 132 formed by the triangular projecting strips 118 attached to the inner surface 112 of the circumferential wall 110. The pocket section 132 having a preset depth designed based on the height of the triangular projecting strips 118 and the diameter and the curvature of the circular ore separation wheel and the height of the riffles 102 assists in the immediate capture of the heavy materials from the mixture of heavy and light materials deposited into the circular ore separation wheel 102, as in block 204. The light materials deposited within the pocket section 132 of the present material separation apparatus 100 are allowed to pass over the triangular projecting strips 118 to the circular lip portion 120 for disposal. The heavy materials retained in the pocket section 132 are moved upwards, using the negative draft by the tilt and riffles, working with back pressure filling the valleys traveling through the valley 124 formed between the saw-tooth shaped projected spiral portions 108, during the rotation of the present material separation apparatus 100 and with the specific gravity pressure of the heavy materials this does not allow for the light materials to displace the heavy materials. In addition, the remaining light materials deposited within the pocket section 132 of the present material separation apparatus 100 are allowed to pass over the ridges 122 of the saw-tooth shaped projected spiral portions 108 with the wetting agent for disposal back down and over the respective parts thereof 132, 118, 120 and 110. The heavy materials gets trapped in the valleys 124 formed between the adjacent teeth or the adjacent triangular projecting strips 118 and with the specific gravity pressure of the heavy materials this does not allow for the light materials to displace the heavy materials which the heavy material gradually moves upward from the periphery 142 towards the central hole 106 of the circular ore separation wheel 102, as shown in block 206. The negative draft angle 144 or the angle less than 90 degrees made by adjacent teeth or the adjacent projected spiral portions 108 enables the entrapment and the gradual upwards movement of the heavy materials having specific gravity of 10 and more during the rotation of the tilted circular ore separation wheel 102. The riffle patterns formed by the microgrooves or adjacent micro lines 130 on the surface of the projected spiral portions 108 creates a molecular air layer, which creates that ability of the encapsulation by a wetting agent such as APSA-80 and water mix around each granule of material, sprayed into the rotating circular ore separation wheel 102 to assist the gradual movement of the heavy materials from the periphery, over the ridges 122 of the projected spiral portions 108, towards the central hole 106 of the circular ore separation wheel 102. The water flows over the ridges 122 and carries the floating light materials, sweeps away towards the bottom of the wheel at parts 132, 118, 120 and 110. The water affects the heavier material on the projected spiral portions 108, and assists it to be caught and transported in the valleys 124 up to the central hole 106 with the rotation of the circular ore separation wheel 102. The heavy materials, after passing through the valleys 124 or the riffle shapes of the projected spiral portions 108, passes through the central hole 106 and are collected for further processing as in block 208.

It is noted that in one embodiment, the dimensions of the teeth or spiral portions 108 may change over the lengths thereof. For example, it is desirous to have all of the individual teeth or spiral portion 108 in a continuous unbroken length, having an inner portion near the central opening 106 having smaller dimensions (like height of teeth, thickness, angles, and valley size) and gradually increasing these dimensions as it reaches the outer periphery of the wheel 102. It is also desirous to change the draft angle of the spiral portions 108 along that same path. Thus resulting in the ability to have a dynamically changing critical dimension on a plurality of teeth or spiral portions 108.

It is noted, that in another embodiment, there is formed at least partially along the surface of the teeth or spiral portion 108, micro grooves that at least partially run along at least a portion of the surfaces. These micro groves, in one embodiment, have proven to be beneficial to the ore separation process during operational periods. The micro grooves may be formed between each layer extruded from a 3D print head when being formed at the outer surface of the teeth 108. These plurality of micro grooves are small gaps located between subsequent extruded layer at the outer surface of the plurality of teeth as illustrated. In another embodiment, the micro grooves range in size from 4.50 mm to 0.001 mm.

It is noted that it is impossible to have complete uniformity of the parallel grooves for every one of the teeth along their substantial length, due to various manufacturing and design efficiencies. Therefore, in one embodiment, it is desired to have at least a good percentage of the teeth to have such micro grooves running substantially the entire length of the teeth. A good percentage can range form 10% to 90%. In another embodiment, all of the teeth will reach the central hole 106, and the valley dimensions will be larger at the outer region and smaller at the inner region of the wheel. Further, the micro-grooves may not all be parallel and may form angles of some sort therebetween. The fact that there are illustrated micro grooves in a somewhat parallel fashion, it is contemplated in this invention to supply micro grooves of any angle to the base on the teeth surfaces.

It is noted that the negative draft angle, or major angle, or any other angle described for the teeth are illustrated as having a flat surface, or parallel surface, or straight surface on the teeth. Whereas, it is contemplated to have a concave or convex surface on any of the faces or surfaces (i.e. backside and front side of each tooth) of the teeth, or ripples. Thus, it is known that the angle now at any one point along the curved face will be different as measured to the base of th wheel. But, prior methods were either unable to do this or it was too expensive to do such. Whereas, in some embodiments, there is an advantage in having a concave or convex surface in some of the faces, in that they will aid in the capture of the material of desire. Additionally, it is contemplated to form the overall major angle to be greater than 90 deg. but to use a concave face, which in affect, will have at least a portion of the face to be less than 90 deg., and thus benefiting from the 3D printing ability to print an overhang or concave region, and thus still having a negative draft affect. So, in one embodiment, only a portion of the front side or back side will be less than 90 deg. In other words, not all of the faces on the teeth are straight, nor all of the surface pieces or parts are completely less than 90 deg., however, at least a portion of the faces of the teeth forming at least a portion of the major angle to be less than 90 deg.

It should be noted that the steps described in the method of use can be carried out in many different orders according to user preference. The use of "step of" should not be interpreted as "step for", in the claims herein and is not intended to invoke the provisions of 35 U.S.C. § 112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

I claim:

1. A material separation apparatus for separating at least one heavy material from a mixture of heavy and light materials, comprising:

a) a circular ore separation wheel having an exterior surface, a concave shaped interior surface, and a central hole;

b) a plurality of projected spiral portions having a saw-tooth cross-section in form of a plurality of teeth making a negative draft angle of less than 90 degrees between a tooth and the concave shaped interior surface;

c) wherein the plurality of projected spiral portions is tilted towards and radially extends out from the central hole to a periphery of the circular ore separation wheel;

d) at least one circumferential wall having an inner surface and an outer surface attached to the periphery of the circular ore separation wheel;

e) a plurality of triangular projecting strips attached to the inner surface of the circumferential wall;

f) a circular lip portion attached to and extending out from a top edge of the circumferential wall; and g) a central hub attached to the central hole of the circular ore separation wheel, tilted at a predetermined tilting angle with a vertical direction, for rotating the circular ore separation wheel at a predetermined speed for separating the at least one heavy material from the mixture of heavy and light materials;

whereby the mixture of heavy and light materials deposited proximate to a periphery of the circular ore separation wheel, tilted at the predetermined tilting angle on a supporting means and rotating at the predetermined speed, enables gradual movement of the heavy materials from the periphery towards the central hole of the circular ore separation wheel;

wherein at least a portion of a surface of the plurality of projected spiral portions are provided with a plurality of adjacent micro lines extending along a length thereof.

2. The material separation apparatus of claim 1, wherein the plurality of adjacent micro line are sized about 4.5-0.001 mm.

3. The material separation apparatus of claim 1, wherein the circular ore separation wheel is used for separation of the plurality of heavy materials including gold having a specific gravity of at least 10.00.

4. The material separation apparatus of claim 1, wherein the projected spiral portions having the saw-tooth cross-section makes the negative draft angle between 10 degrees to 89 degrees and is measured between a leading face of the teeth and a bottom surface of the wheel.

5. The material separation apparatus of claim 1, wherein the plurality of projected spiral portions having the saw-tooth cross-section forms a plurality of ridges and a plurality of valleys connecting the ridges, wherein the plurality of ridges have a greater height on a periphery of the wheel then found at an inner region of the wheel.

6. The material separation apparatus of claim 5, wherein the plurality of valleys formed by the adjacent teeth is curved to guide the heavy materials with specific gravity of at least 10.00 to the central hole.

7. The material separation apparatus of claim 6, wherein a height of the plurality of ridges of the plurality of projected spiral portions tilted towards the central hole gradually decreases from the periphery of the circular ore separation wheel to the central hole.

8. The material separation apparatus of claim 1, wherein the inner surface of the circumferential wall with the plurality of triangular projecting strips forms a curved pocket section with the periphery of the circular ore separation wheel; and wherein a depth of the curved pocket section is pre-selected based on a plurality of factors including the diameter of the circular ore separation wheel to enable immediate capture of the heavy materials and instant disposal of the light materials from the mixture of heavy and light materials deposited into the curved pocket section.

9. The material separation apparatus of claim 1, wherein the circumferential wall attached to the periphery of the circular ore separation wheel makes an angle between 0 degrees to 10 degrees to the vertical direction.

10. The material separation apparatus of claim 1, wherein the plurality of triangular projecting strips attached to the inner surface of the circumferential wall angularly extends from a bottom edge to the top edge of the circumferential wall;

wherein the plurality of triangular projecting strips attached to the inner surface of the circumferential wall enables instant capture of the heavy materials in the pocket section and instant disposal of the light materials from the mixture of light and heavy materials over the triangular projecting strips and the circular lip portion.

11. The material separation apparatus of claim 1, wherein a height and number of the plurality of triangular projecting strips attached to the inner surface of the circumferential wall is 2 to 6 to cover an entire circumfeence thereof.

12. The method of claim 3, wherein at least a portion of the negative draft angle between the adjacent teeth is a value selected between 10 degrees to 89 degrees.

13. The method of claim 12, wherein the tilting angle of the circular ore separation wheel is an acute angle selected less than 90 degrees.

14. A material separation apparatus for separating at least one heavy material from a mixture of heavy and light materials, comprising:

a) a support structure, having an interior surface, a central hole formed therethrough, and a periphery around the interior surface;

b) a circumferential wall having an inner surface attached to the periphery of the support structure;

c) an ore separation pad, positioned on the interior surface, having a plurality teeth spiralling out from the central hole to the periphery thereof; and d) wherein the plurality of teeth includes at least a poriton of the surface having a plurality of micro grooves extending longitudinally along surfaces of the plurality of teeth.

15. The apparatus of claim 14, wherein the plurality of micro grooves include a gap of about a 4.5 to 0.001 mm located on an outer surface of the plurality of teeth.

16. The apparatus of claim 15, further comprising:

a. a plurality of triangular projecting strips attached to the inner surface of the circumferential wall;

b. a circular lip portion attached to and extending out from a top edge of the circumferential wall; and c. a central hub attached to the central hole of the circular ore separation wheel, tilted at a predetermined tilting angle with a vertical direction, for rotating the circular ore separation wheel at a predetermined speed for separating the at least one heavy material from the mixture of heavy and light materials.

* * * * *